US006706419B2

(12) United States Patent
Yoshinaga et al.

(10) Patent No.: US 6,706,419 B2
(45) Date of Patent: Mar. 16, 2004

(54) COLD-ROLLED STEEL SHEET OR HOT-ROLLED STEEL SHEET EXCELLENT IN PAINTING BAKE HARDENABILITY AND ANTI AGING PROPERTY AT ROOM TEMPERATURE, AND METHOD OF PRODUCING THE SAME

(75) Inventors: Naoki Yoshinaga, Futtsu (JP); Manabu Takahashi, Futtsu (JP); Natsuko Sugiura, Futtsu (JP); Akihiro Miyasaka, Futtsu (JP); Masaaki Sugiyama, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 16 days.

(21) Appl. No.: 10/110,163

(22) PCT Filed: Aug. 1, 2001

(86) PCT No.: PCT/JP01/06635

§ 371 (c)(1),
(2), (4) Date: Apr. 4, 2002

(87) PCT Pub. No.: WO02/12580

PCT Pub. Date: Feb. 14, 2002

(65) Prior Publication Data

US 2002/0197508 A1 Dec. 26, 2002

(30) Foreign Application Priority Data

Aug. 4, 2000 (JP) ..... 2000-237510

(51) Int. Cl.[7] ..... B32B 15/18; B32B 31/00; C22C 38/00; C21D 8/02

(52) U.S. Cl. ..... 428/659; 148/533; 148/602; 148/648; 148/650; 148/651; 148/654; 148/661; 148/320; 420/8; 420/128; 428/939

(58) Field of Search ..... 428/659, 939; 148/533, 602, 648, 650, 651, 654, 661, 320; 420/8, 128

(56) References Cited

U.S. PATENT DOCUMENTS 5,690,755 A * 11/1997 Yoshinaga et al. ..... 148/533

FOREIGN PATENT DOCUMENTS

| | | |
|---|---|---|
| JP | 59-31827 | 2/1984 |
| JP | 60-174852 | 9/1985 |
| JP | 61-257421 | 11/1986 |
| JP | 6-136450 | 5/1994 |
| JP | 6-240367 | 8/1994 |
| JP | 7-188771 | 7/1995 |
| JP | 7-278654 | 10/1995 |
| JP | 7-278770 | 10/1995 |
| JP | 7-300623 | 11/1995 |
| JP | 7-316649 | 12/1995 |
| JP | 8-143953 | 6/1996 |

* cited by examiner

*Primary Examiner*—Robert R. Koehler
(74) *Attorney, Agent, or Firm*—Kenyon & Kenyon

(57) ABSTRACT

To provide a steel sheet excellent in painting bake hardenability and anti aging property at room temperature: containing, in mass, 0.0001 to 0.20% of C, 2.0% or less of Si, 3.0% or less of Mn, 0.15% or less of P, 0.015% or less of S, and, in addition, 010% or less of Al and 0.001 to 0.10% of N so as to satisfy the expression 0.52Al/N<5 and, further, one or more of 2.5% or less of Cr, 1.0% or less of Mo and 0.1% or less of V so as to satisfy the expression (Cr+3.5MO+39V) ≧0.1, with the balance consisting of Fe and unavoidable impurities; having the value of BH170, evaluated after applying a 2% tensile deformation and then a heat treatment at 170° C. for 20 min., being 45 MPa or more, and any of the value of BH160, evaluated after applying a 2% tensile deformation and then a heat treatment at 160° C. for 10 min., and the value of BH150, evaluated after applying a 2% tensile deformation and then a heat treatment at 150° C. for 10 min., being 35 MPa or more; and having the yield point elongation at a tensile test after applying a heat treatment at 100° C. for 1 h. being 0.6% or less.

21 Claims, No Drawings

COLD-ROLLED STEEL SHEET OR HOT-ROLLED STEEL SHEET EXCELLENT IN PAINTING BAKE HARDENABILITY AND ANTI AGING PROPERTY AT ROOM TEMPERATURE, AND METHOD OF PRODUCING THE SAME

TECHNICAL FIELD

This invention relates to a steel sheet having painting bake hardenability (BH), anti aging property at room temperature and formability at the same time, and a method of producing the steel sheet.

The letters BH are an abbreviation of bake hardenability or bake hardening and it means a simplified evaluation, by means of a tensile test, of the increase in the mechanical strength of a steel sheet resulting from the baking of a painting after press forming in car manufacturing. BH is measured as follows: first, the flow stress of a steel sheet is measured under a 2% tensile deformation imposed at a tensile test; then, after a prescribed heat treatment (usually, at 170° C. for 20 min., but heat treatments at 150° C. and 160° C. are also included in the present invention), the upper yield stress of the steel sheet is measured in another tensile test; suppose the flow stress at the first tensile test under the 2% tensile deformation is $\sigma 1$ and the upper yield stress at the second tensile test is $\sigma 2$, the amount of EH is given as $\sigma 2$-$\sigma 1$. Note that, when there is no upper yield point, the 0.2% proof stress of the steel sheet is used.

A steel sheet according to the present invention is used for cars, home electric appliances, buildings, etc. and it includes both a cold-rolled or hot-rolled steel sheet in the narrow sense of the word without surface treatment and a cold-rolled or hot-rolled steel sheet in the broad sense of the word with surface treatment such as alloying hot dip galvanizing, electrolytic plating, etc. as an anti-corrosion measure.

BACKGROUND ART

The production of ultra low carbon steels has been made easier thanks to the latest technical advancement of the vacuum degassing treatment of molten steel, and the demands for ultra low carbon steels having excellent workability has been increasing. Among this kind of product, the ultra low carbon steel sheets containing Ti and Nb added in combination disclosed in Japanese Unexamined Patent Publication No. S59-31827 and the like, for example, have painting bake hardenability (BH) as well as extremely good workability, and are excellent also in hot dip galvanizing property. For this reason, these steel sheets have come to claim a significant position in the market.

The amount of BH of the steel sheets, however, is not beyond the level of those of conventional BH steel sheets, and they have a shortcoming that, when it is attempted to increase the amount of BH of the steel sheets, it becomes impossible to maintain their anti aging property at room temperature.

A steel sheet having an enhanced BH is excellent in workability thanks to its low strength at the stage of press forming, and is also excellent especially in dent resistance owing to the fact that it becomes hard after it is finally formed into the shape of a product component. Generally speaking, when the amount of solute C or solute N in steel is increased, the amount of BH is increased but, on the other hand, anti aging property at room temperature poses a problem.

As an example of the technology related to a steel sheet having both high bake hardenability and anti aging property at room temperature, Japanese Examined Patent Publication No. H3-2224 proposes a technology to obtain a cold-rolled steel sheet having a high r-value, high bake hardenability, good ductility and anti aging property at room temperature at the same time, by adding a large amount of Nb, B and Ti, together, to an ultra low carbon steel so as to make the annealed structure of the steel a composite structure consisting of a ferrite phase and a phase formed through low temperature transformation.

It has been made clear, however, that the proposed technology has problems related to actual production operation as described in 1) and 2) below.

1) In a steel having a composition comprising a large amount of Nb, B and Ti, the transformation point where the steel transforms from $\alpha$ phase to $\gamma$ phase does not fall and thus annealing at a very high temperature is required for obtaining a composite structure, which in turn causes troubles such as strip breakage during continuous annealing.
2) Since the temperature range where the steel has an $\alpha+\gamma$ phase is very narrow, there arises the case that the structure varies along the width of the steel sheet resulting in the large dispersion of product quality or that the structure may or may not become a composite structure depending on the fluctuation of annealing temperature by several degrees Celsius. Therefore, the production tends to be very unstable.

As another example, Japanese Unexamined Patent Publication No. H7-300623 teaches that it is possible to obtain both a high BE value and anti aging property at room temperature, by increasing the carbon concentration at crystal grain boundaries of an ultra low carbon cold-rolled steel sheet containing Nb through controlling the cooling rate after annealing. The technology disclosed therein, however, does not realize a high BH value and anti aging property at room temperature in a sufficiently well-balanced manner.

There is another problem in conventional BH steel sheets that, whereas a prescribed amount of BH is obtained as far as the heat treatment of BH is conducted under a condition of 170° C. for 20 min., the amount of BH is lowered under a heat treatment condition of 160° C. for 10 min. or 150° C. for 10 min.

As described above, conventional BH steel sheets have shortcomings that stable production is difficult and that anti aging property at room temperature is lost when the amount of BH is increased Further, they have another problem in that a sufficient amount of BH is not obtained when the temperature at the baking of a painting is lowered from currently adopted 170° C. to 160 or 150° C.

DISCLOSURE OF THE INVENTION

The object of the present invention is to provide a steel sheet having both high bake hardenability and anti aging property at room temperature and capable of maintaining a sufficient amount of BH even under a low BH temperature, and a method of producing the steel sheet.

As a result of assiduous studies for achieving the above object, the present inventors obtained the following finding which was hitherto unknown.

That is to say, the present inventors discovered that it was possible, by adding Cr, MO, V and so forth to a steel retaining solute N, to obtain both a high BH value and anti aging property at room temperature and maintain high bake hardenability even when the baking of a painting was conducted at a lower temperature for a shorter period of time.

The present invention is a totally new steel sheet which was hitherto unknown to the market, worked out on the basis of the philosophy and findings described above, and a method of producing the steel sheet. The gist, therefore, is as follows:

(1) A cold-rolled steel sheet excellent in painting bake hardenability and anti aging property at room temperature characterized by: containing, in mass, 0.0001 to 0.20% of C, 2.0% or less of Si, 3.0% or less of Mn, 0.15% or less of P, 0.015% or less of S and, in addition, 0.10% or less of Al and 0.001 to 0.10% of N so as to satisfy the expression 0.52Al/N<5 and, further, one or more of 2.5% or less of Cr, 1.0% or less of Mo and 0.1% or less of V so as to satisfy the expression (Cr+3.5Mo +39V)≧0.1, with the balance consisting of Fe and unavoidable impurities; having the value of BE170, which is evaluated after applying a 2% tensile deformation and then a heat treatment at 170° C. for 20 min., equal to or more than 45 MPa, and any of the value of BH160, which is evaluated after applying a 2% tensile deformation and then a heat treatment at 160° C. for 10 min., and the value of BH150, which is evaluated after applying a 2% tensile deformation and then a heat treatment at 150° C. for 10 min., equal to or more than 35 MPa; and having the yield point elongation at a tensile test after applying a heat treatment at 100° C. for 1 h. equal to or less than 0.6%.

(2) A hot-rolled steel sheet excellent in painting bake hardenability and anti aging property at room temperature characterized by: containing, in mass, 0.0001 to 0.20% of C, 2.0% or less of Si, 3.0% or less of Mn, 0.15% or less of P, 0.015% or less of S and, in addition, 0.20% or less of Al and 0.001 to 0.10% of N so as to satisfy the expression 0.52Al/N<10 and, further, one or more of 2.5% or less of Cr, 1.0% or less of MO and 0.1% or less of v so as to satisfy the expression (Cr+3.5Mo +39v)≧0.1, with the balance consisting of Fe and unavoidable impurities; having the value of BH170, which is evaluated after applying a 2% tensile deformation and then a heat treatment at 170° C. for 20 min., equal to or more than 45 MPa, and any of the value of BH160, which is evaluated after applying a 2% tensile deformation and then a heat treatment at 160° C. for 10 min., and the value of BH150, which is evaluated after applying a 2% tensile deformation and then a heat treatment at 150° C. for 10 min., equal to or more than 35 MPa; and having the yield point elongation at a tensile test after applying a heat treatment at 100° C. for 1 h. equal to or less than 0.6%.

(3) A cold-rolled or hot-rolled steel sheet excellent in painting bake hardenability and anti aging property at room temperature according to the item (1) or (2), characterized by containing 0.0005 to 0.004%, in mass, of solute N.

(4) A cold-rolled or hot-rolled steel sheet excellent in painting bake hardenability and anti aging property at room temperature according to any one of the items (1) to (3), characterized by containing, further, 0.0005 to 0.01%, in mass, of Ca.

(5) A cold-rolled or hot-rolled steel sheet excellent in painting bake hardenability and anti aging property at room temperature according to any one of the items (1) to (4), characterized by containing, yet further, 0.0001 to 0.001%, in mass, of B.

(6) A cold-rolled or hot-rolled steel sheet excellent in painting bake hardenability and anti aging property at room temperature according to any one of the items (1) to (5), characterized by containing, in addition, 0.001 to 0.03%, in mass, of Nb.

(7) A cold-rolled or hot-rolled steel sheet excellent in painting bake hardenability and anti aging property at room temperature according to any one of the items (1) to (6), characterized by containing, moreover, 0.0001 to 0.10%, in mass, of Ti so as to satisfy the expression (N−0.29Ti)>0.0005.

(8) A cold-rolled or hot-rolled steel sheet excellent in painting bake hardenability and anti aging property at room temperature according to any one of the items (1) to (7), characterized by containing, furthermore, one or more of Sn, Cu, Ni, Co, Zn, W, Zr and Mg to a total of 0.001 to 1.0%, in mass.

(9) A galvanized cold-rolled steel sheet excellent in painting bake hardenability and anti aging property at room temperature characterized by applying a hot dip galvanizing, an alloying hot dip galvanizing or an electrogalvanizing to a cold-rolled steel sheet according to any one of the items (1) and (3) to (8).

(10) A galvanized hot-rolled steel sheet excellent in painting bake hardenability and anti aging property at room temperature characterized by applying a hot dip galvanizing, an alloying hot dip galvanizing or an electrogalvanizing to a hot-rolled steel sheet according to any one of the items (2) and (3) to (8).

(11) A method of producing a cold-rolled steel sheet excellent in painting bake hardenability and anti aging property at room temperature characterized by: hot-rolling a slab having the chemical composition according to any one of the items (1) and (3) to (8) at a temperature 100° C. below the $Ar_3$ transformation temperature or higher; cold-rolling the hot-rolled steel sheet thus produced at a reduction ratio of 95% or less; annealing the cold-rolled steel sheet thus produced so that the maximum heating temperature attains the temperature range from 600 to 1,100° C.; and then cooling it from the annealing temperature to a temperature of 400° C. or lower at an average cooling rate of 10° C./sec. or more.

(12) A method of producing a cold-rolled steel sheet excellent in painting bake hardenability and anti aging property at room temperature characterized by: hot-rolling a slab having the chemical composition according to any one of the items (1) and (3) to (8) at a temperature 100° C. below the $Ar_3$ transformation temperature or higher; cold-rolling the hot-rolled steel sheet thus produced at a reduction ratio of 95% or less; annealing the cold-rolled steel sheet thus produced so that the maximum heating temperature attains the temperature range from 600 to 1,100° C.; then cooling it from the annealing temperature to a temperature of 400° C. or lower at an average cooling rate of 10° C./sec. or more; and then applying to it an overaging treatment at the temperature range from 150 to 400° C. for 120 sec. or longer.

(13) A method of producing a hot-dip-galvanized cold-rolled steel sheet excellent in painting bake hardenability and anti aging property at room temperature characterized by; hot-rolling a slab having the chemical composition according to any one of the items (1) and (3) to (8) at a temperature 100° C. below the $Ar_3$ transformation temperature or higher; cold-rolling the hot-rolled steel sheet thus produced at a reduction ratio of 95% or less; and then, in a continuous hot dip galvanizing line, annealing the cold-rolled steel sheet thus produced so that the maximum heating temperature attains the temperature range from 600° C. to 1,100° C.; then cooling it from the annealing temperature to the temperature of the galvanizing bath at an average cooling rate of 10° C./sec. or more, and applying a hot dip galvanizing to it.

(14) A method of producing an alloying-hot-dip-galvanized cold-rolled steel sheet excellent in painting bake hardenability and anti aging property at room temperature characterized by conducting a heat treatment in a temperature range from 460 to 650° C. for 3 sec. or longer after the hot dip galvanizing specified in the method of producing a hot-dip-galvanized cold-rolled steel sheet according to the item (13).

(15) A method of producing a hot-rolled steel sheet excellent in painting bake hardenability and anti aging property at room temperature characterized by: hot-rolling a slab having the chemical composition according to any one of the items (2) and (3) to (8) at a temperature 100° C. below the $Ar_3$ transformation temperature or higher; cooling the hot-rolled steel sheet thus produced from the hot rolling finishing temperature to a temperature of 600° C. or below at an average cooling rate of 10° C./sec. or more; and then coiling it at a temperature of 550° C or below.

BEST MODE FOR CARRYING OUR THE INVENTION

The reasons why the chemical composition of steel and the production conditions are specified as above in the present invention will be explained in more detail hereafter.

C is an element to increase steel strength economically, and its addition amount varies depending on the level of envisaged strength. However, decreasing the content of C to below 0.0001% is difficult for the reasons of steelmaking technology, and it not only incurs a cost increase but also deteriorates the fatigue property of welded portions. For this reason, the lower limit of the addition amount of C is set at 0.0001%. When the amount of C exceeds 0.20%, on the other hand, formability and weldability are adversely affected and, besides, it becomes difficult to obtain both good bake hardenability and anti aging property at room temperature at the same time, which is a key issue in the present invention. The upper limit of the addition amount of C is, therefore, set at 0.20%. When the present invention is applied to the members to which deep drawing formability is required, it is preferable to control the content of C within a range from 0.0001 to 0.0020% or from 0.012 to 0.024%.

It is desirable that the amount of solute C is 0.0020% or less. Since high bake hardenability and anti aging property at room temperature are secured according to the present invention mainly by means of the addition of N, when the amount of solute C is too large, it becomes difficult to maintain good anti aging property at room temperature. It is more preferable to control the amount of solute C to below 0.0010%. The amount of solute C may be controlled by restricting the amount of total C to the upper limit specified above or less, otherwise by lowering it to the prescribed level through controlling the coiling temperature or the condition of the overaging treatment.

Si is a solid solution hardening element and increases strength. It is also effective for forming a structure containing martensite, bainite and, in addition, a retained γ phase and the like. While the addition amount of Si varies depending on the level of envisaged strength, when it exceeds 2.0%, press formability and a chemical treatment property are deteriorated. For this reason, the upper limit of the addition amount of Si is set at 2.0%. When an alloying hot dip galvanizing is applied, an addition of Si in a great amount results in problems such as low productivity caused by poorer plating adhesion and slower alloying reactions and, therefore, the upper limit of the Si content is set at 0.8%. No lower limit of Si is set specifically but, since lowering the Si content to 0.001% or less causes production cost increase, 0.001% is the lower limit in practical sense. If it is difficult to deoxidize steel with Al because of a requirement to control the amount of Al, Si may be used for deoxidation. In this case, 0.04% or more of Si is to be included in steel.

Mn is useful as a solid solution hardening element.

It is also effective for forming MnS to suppress the occurrence of edge cracks caused by S during hot rolling, fining the structure of hot-rolled sheets and forming the structure containing martensite, bainite and, in addition, a retained γ phase and the like. Moreover, Mn has the effect to inhibit aging at room temperature caused by solute N. For these reasons, it is desirable to add 0.3% or more of Mn. When deep drawability is required, however, it is desirable to limit the content of Mn to 0.15% or less, preferably, to below 0.10% When the addition amount of Mn exceeds 3.0%, on the other hand, the strength becomes so high that ductility is decreased and the plating adhesion of galvanizing is adversely affected. The upper limit of the addition amount of Mn is, therefore, set at 3.0%.

P is known as an element to raise strength economically, like Si, thus, when it is necessary to increase strength, P is added intentionally. P also has the effects to make fine a hot-rolled structure and enhance workability, when it is added in excess of 0.15%, however, it deteriorates the fatigue strength after spot welding, and also increases yield strength too much causing poor planar shape at press forming. The excessive addition of P also lowers productivity since it drastically slows down the alloying reactions during continuous hot dip galvanizing, and the workability in secondary working is deteriorated, too. The upper limit of the addition of P is, therefore, set at 0.15%.

The upper limit of the addition of S is set at 0.015%, since the addition of S in excess of 0.015% causes hot cracking and the deterioration of workability.

Al may be added for oxidizing. However, since Al combines with N to form AlN and, thus, lowers bake hardenability, it is desirable to limit its addition to the least necessary amount within the range not to make production technically difficult. From this point of view, its upper limit for a cold-rolled steel sheet is set at 0.10% when the Al content exceeds 0.10%, it becomes necessary to add a large amount of N in order to secure a required amount of solute N, which is disadvantageous in terms of production costs and formability. A more preferable upper limit is 0.02%, and a still more preferable upper limit is 0.007%. In the case of a hot-rolled steel sheet, on the other hand, it is possible to secure a sufficient amount of solute N by rapid cooling after hot rolling, even when more Al than N is included in terms of the number of atoms. For this reason, an upper limit of the Al content may be 0.20%. Production is made easier still when the Al content is 0.05% or less or, more preferably, 0.02% or less.

N is an important element in the present invention: good bake hardenability in the present invention is achieved mainly by using N. It is therefore essential to add 0.001% or more of N. When the content of N is too high, on the other hand, it becomes difficult to secure anti aging property at room temperature, or workability is deteriorated. For this reason, the upper limit of the N content is set at 0.10%. A preferable range of the N content is from 0.002 to 0.020% or, more preferably, from 0.002 to 0.008%. Besides the above, because N easily combines with Al to form AlN, it is necessary to maintain the value of 0.52Al/N equal to or smaller than a prescribed value in order to secure a sufficient amount of N which contributes to the improvement of bake hardenability. In the case of a cold-rolled steel sheet, it is necessary that the expression 0.52Al/N<5 is satisfied since AlN easily precipitates during the heating and the holding of the temperature in an annealing process. It is preferable to satisfy the expression 0.52Al/N<4 or, more preferably, 0.52Al/N<3.

However, if annealing is conducted at a high heating rate and for a short holding time, the range of the value of 0.52Al/N may be equal to that of a hot-rolled steel sheet.

In the case of a hot-rolled steel sheet, in contrast, the value of 0.52Al/N is defined as follows, when the value of 0.52Al/N is 10 or more, AlN easily precipitates during the cooling and coiling after hot rolling and, for this reason, the upper limit of the value of 0.52Al/N has to be below 10. When the value of 0.52Al/N is kept below 10, an excessive precipitation of AlN can be avoided by properly controlling the cooling rate and coiling temperature after hot rolling, and good bake hardenability can be realized. A more preferable upper limit of the value of 0.52Al/N is 5.

Cr, No and V are important elements in the present invention; it is indispensable to add one or more of these elements to the steel. Good bake hardenability and anti aging property at room temperature are obtained at the same time only when one or more of them are added.

It is known to be difficult to secure anti aging property at room temperature when more than a prescribed amount of N is included in steel, because N diffuses more rapidly than C does. For this reason, BH steel sheets using N are not applied to the members for which appearance is important such as the outer panels of a car body.

The present inventors, however, noted as a new discovery that it was possible to obtain anti aging property at room temperature without deteriorating bake hardenability, by adding Cr, Mo and/or V intentionally.

The mechanism through which the anti aging property at room temperature is enhanced by one or more of these elements is not altogether clear, but it is speculated to be as follows.

These elements form pairs and/or clusters together with N near room temperature, inhibiting the diffusion of N, and this secures anti aging property at room temperature. During the baking treatment of painting at 150 to 170° C., in contrast, N leaves of the pairs and clusters to fix dislocations, and this causes high bake hardenability to show.

The upper limits of the addition amounts of Cr, Mo and V, which are determined in consideration of workability and production costs, are 2.5, 1.0 and 0.1%, respectively. When added too much, V forms nitrides and it becomes difficult to secure a sufficient amount of solute N. Therefore, it is desirable to limit the addition of V to 0.04% or less.

In order to secure anti aging property at room temperature, Cr, Mo and/or V must be added so that the expression $(Cr+3.5Mo+39V) \geqq 0.1$ is satisfied. It is more desirable if the expression $(Cr+3.5Mo+39V) \geqq 0.4$ is satisfied. Further, for securing anti aging property at room temperature, it is more effective to add two or more of Cr, Mo and V together than to add one of them individually.

The amount of solute N has to be 0.0005 to 0.004% in total. Here, the solute N includes not only the N existing in Fe independently but also the N forming pairs or clusters with substitutional solute elements such as Cr, Mo, V, Mn, Si and P. The amount of solute N can be appropriately determined by the heating extraction method in a hydrogen gas flow. In the method, the amount of solute N is obtained by heating a sample to a temperature range from 200 to 500° C. or so, forming ammonia through a reaction of the solute N with the hydrogen, analyzing the ammonia thus formed by mass spectrometry, and converting the amount of ammonia thus obtained.

The amount of solute N can be calculated also by subtracting the amount of N existing as compounds such as AlN, NbN, VN, TiN, BN, etc. (determined through chemical analysis of the residue of the extraction) from the amount of total N. It may be obtained by the internal friction method or the field ion microscopy (FIN), too.

When the amount of solute N is below 0.0005%, sufficient bake hardenability is not obtained. When the amount of solute N exceeds 0.004%, on the other hand, while bake hardenability is improved, it becomes difficult to obtain anti aging property at room temperature. A more preferable range of the amount of solute N is from 0.0012 to 0.003%.

Ca is effective for deoxidizing and also for controlling the shape of sulfides and, therefore, 0.0005 to 0.01% of Ca may be added. With an addition below 0.0005%, a sufficient effect is not obtained but, when added in excess of 0.01%, workability is deteriorated. For this reason, the range of the Ca addition has to be from 0.0005 to 0.01%.

B is added, as required, by 0.0001 to 0.001% because it is effective for preventing the embrittlement of steel during secondary working. With an addition below 0.0001%, a tangible effect is not obtained and, when added in excess of 0.001%, however, the effect is saturated and, besides, BN is likely to form and it becomes difficult to secure a sufficient amount of solute N. A more preferable range of the B addition is from 0.0001 to 0.0004%.

Nb is added, as required, within a range from 0.001 to 0.03%, as it is effective for enhancing workability and strength and also for forming a fine and homogeneous structure. When the amount of its addition is below 0.001%, however, the effects of its addition do not show and, when added in excess of 0.03%, in contrast, NbN is likely to form and it becomes difficult to secure a sufficient amount of solute N. A more preferable range of the Nb addition is from 0.001 to 0.012%.

Ti has the same effects as Nb and, for this reason, it is added, as required, within a range from 0.0001 to 0.10%. When the amount of its addition is below 0.0001%, however, the effects do not show and, when added in excess of 0.10%, on the other hand, a large amount of N precipitates or crystallizes in the form of TiN and, thus, it becomes difficult to secure a sufficient amount of solute N. A desirable range of the Ti addition is from 0.001 to 0.020% or, more preferably, from 0.001 to 0.012%. Besides the above, in order to secure a sufficient amount of solute N, Ti must be added within the range to satisfy the expression $(N-0.29Ti) > 0.0005$ or, more preferably, $(N-0.29Ti) > 0.0010$.

A total of 0.001 to 1.0% of one or more of Sn, Cu, Ni, Co, Zn, W, Zr and Mg may be added to a steel containing the above elements as main components. However, since Zr forms ZrN, its addition is limited, desirably, to 0.01% or less.

Next, the reasons why the production conditions are specified in the present invention will be explained.

The slab to be hot-rolled is not restricted specifically in terms of its production conditions: it may be a continuously cast slab or a slab produced using a thin slab caster or the like. A slab produced by a process such as the continuous casting-direct rolling (CC-DR) process in which the slab is hot-rolled immediately after it is cast is also suitable for the present invention.

In the case that a hot-rolled steel sheet is used as a final product, it is necessary to specify its production conditions as follows. The finishing temperature of the hot rolling must not be below the Ar transformation temperature by 100° C. or more. If the finishing temperature is below the $Ar_3$ transformation temperature by more than 100° C., it becomes difficult to obtain good workability or thickness accuracy. A more preferable finishing temperature range is the $Ar_3$ transformation temperature or higher. No upper limit is set specifically as to the finishing temperature of the hot rolling, but it is desirable that the temperature is 1,100° C. or lower in order to prevent coarse crystal grains from forming and to protect the hot rolling rolls.

Note that the heating temperature of the hot rolling is not specifically restricted. But, when it is necessary to melt AlN in order to obtain a sufficient amount of solute N, it is desirable to heat a slab to 1,200° C. or higher.

After hot rolling, it is necessary to cool a hot rolled steel sheet so that an average cooling rate of 10° C./sec. or more is maintained from the finishing temperature of the hot rolling to at least 600° C., in order to suppress the precipitation of AlN.

The present inventors also discovered that, even when an excessive amount of N was added in proportion to Al, that is, even when the expression $0.52Al/N<1$ was true, it was essential, for securing high bake hardenability and anti aging property at room temperature, to keep the cooling rate at 10° C./sec. or higher. It is more desirable for bake hardenability and anti aging property at room temperature if the cooling rate is 30° C./sec. or higher. No upper limit of the cooling rate is set specifically, but it is desirable from the productivity viewpoint to cool the steel sheet at a cooling rate of 200° C./sec. or lower.

In order to suppress the precipitation of AlN, the coiling temperature has to be 550° C. or lower or, more desirably, 450° C. or lower.

The structure of the hot-rolled steel sheet obtained according to the present invention contains ferrite or bainite as the main phase, but it is acceptable if both of them exist as a mixture. It is also acceptable if martensite, austenite, carbides and/or nitrides exist in the mixture. This means that different structures may be formed in accordance with required characteristics.

It is acceptable to apply to the steel sheet after the hot rolling, as required, a pickling and then a skin-pass rolling, either in-line or off-line, at a reduction ratio of 10% or less or a cold rolling at a reduction ratio up to 40% or so.

Then, the production conditions in the case that a cold-rolled steel sheet is used as a final product are explained.

In order to obtain good workability of the final product, it is necessary that the finishing temperature of the hot rolling is 100° C. below the $Ar_3$ transformation temperature or higher. No upper limit is set specifically as to the finishing temperature of the hot rolling, but it is desirable that the temperature is 1,100° C. or lower in order to prevent coarse crystal grains from forming and protect hot rolling rolls.

The reduction ratio of the cold rolling must be 95% or less. A reduction ratio exceeding 95% is undesirable because not only does the load on a rolling apparatus become too large, but also the mechanical property of the product becomes largely anisotropic A desirable reduction ratio is 86% or less. No lower limit is set specifically as to the reduction ratio of the cold rolling, but it is desirable to set the reduction ratio at 60% or more when good deep drawability is required.

The maximum temperature of the annealing must be 600 to 1,100° C. When the annealing temperature is below 600° C., recrystallization is incomplete and workability becomes poor, when the annealing temperature exceeds 1,100° C., on the other hand, the structure becomes coarse and workability is deteriorated. A more preferable range of the annealing temperature is from 650 to 900° C.

The cooling after annealing is important in the present invention: a steel sheet having both high bake hardenability and anti aging property at room temperature can be produced only when an average cooling rate of 10° C./sec. or higher is maintained during the cooling down to 400° C. or lower after completing the annealing. It is desirable to set the cooling rate at 30° C./sec. or higher or, more preferably, 50° C./sec. or higher. No upper limit is set specifically as to the average cooling rate after completing the annealing, but it is preferable from the productivity viewpoint to conduct the cooling at 200° C./sec. or lower.

The overaging treatment after the cooling may be conducted as appropriate in accordance with the objects such as the control of the structure, the decrease of the amount of solute C, and so forth. For obtaining both high bake hardenability and anti aging property at room temperature, however, it is desirable to set the averaging temperature at 400° C. or lower, preferably 350° C. or lower or, more preferably, 300° C. or lower. When the overaging treatment has to be applied, it is desirable that its duration is 60 sec or more but, from the viewpoint of productivity, 600 sec. or less.

When a hot dip galvanizing is to be applied, the average cooling rate from the annealing temperature to the temperature of the galvanizing bath has to be 10° C./sec. or higher. In this case, too, for further enhancing bake hardenability and anti aging property at room temperature, it is desirable to set the average cooling rate at 30° C./sec. or higher or, more preferably, 50° C./sec. or higher. No upper limit is set specifically as to the average cooling rate until the galvanizing bath, but it is preferable from the productivity viewpoint to cool at 200° C./sec. or slower. When a Zn-Fe alloying treatment is required after the galvanizing, the steel sheet has to be reheated to 460 to 650° C. and held at the temperature for 3 sec. or more or, preferably, to 470 to 550° C. and held there for 15 sec. or more. No upper limit is set specifically for the duration of the alloying heat treatment, but it is preferable from the productivity viewpoint to limit the time to 1 min. or less.

For further improving anti aging property at room temperature and correcting the shape of the steel sheet, it is desirable to apply a skin-pass rolling at a reduction ratio of 31% or less. When the reduction ratio exceeds 3%, yield strength is raised and the load on a rolling facility becomes too large. The upper limit of the reduction ratio is, therefore, set at 3%.

The structure of the cold-rolled steel sheet obtained according to the present invention contains ferrite or bainite as the main phase, but it is acceptable if both of them exist as a mixture. It is also acceptable if martensite, austenite, carbides and/or nitrides exist in the mixture. This means that different structures may be formed in accordance with required characteristics.

The value of BH170 of the steel sheet produced according to the present invention is 45 MPa or higher, and any of its BH160 and BH150 values is 35 MPa or higher. More preferable ranges are 60 MPa or higher for BH170 and 50 MPa or higher for both BH160 and BH150. No upper limits are set specifically for these values but, when the value of BH170 exceeds 140 MPa and those of BH160 and BH150 exceed 130 MPa, it becomes difficult to secure anti aging property at room temperature.

It has to be noted that; BH170 means the value of bake hardenability evaluated after applying a 2% tensile deformation and then a heat treatment at 170° C. for 20 min.; BH160 the value of bake hardenability evaluated after applying a 2% tensile deformation and then a heat treatment at 160° C. for 10 min.; and BH150 the value of bake hardenability evaluated after applying a 2% tensile deformation and then a heat treatment at 150° C. for 10 min.

The anti aging property at room temperature is evaluated in terms of the yield point elongation after an artificial aging treatment. The yield point elongation of the steel sheet produced according to the present invention at a tensile test after a heat treatment at 100° C. for 1 h. is 0.6% or less. A preferable value is 0.4% or less or, more preferably, 0.3% or less. It is desirable that the yield point elongation after a heat treatment at 40° C. for 70 days is 0.5% or less, preferably 0.3% or less or, more preferably, 0.2% or less.

The present invention will be explained hereafter based on examples.

EXAMPLE

Example 1

Steels having the chemical compositions shown in Table 1 were produced and hot-rolled under the conditions shown in Table 2, wherein the slab heating temperature was 1,250° C. for all the steels. After applying a skin-pass rolling at a reduction ratio of 1.0%, No. 5 test pieces specified in Japanese Industrial Standard (JIS No. 5 test pieces) were cut out, and the bake hardenability and the yield point elongation after an artificial aging treatment were measured. The structure of the steel sheets thus produced and their mechanical properties are shown in Table 2. As is clear from the table, when steels having the chemical compositions according to the present invention were hot-rolled under appropriate conditions, both high bake hardenability and anti aging property at room temperature were obtained at the same time.

TABLE 1

| steel | C | Si | Mn | P | S | Al | Cr | Mo | V | Ca | O | Ti | Nb | B | N | others |
|---|---|---|---|---|---|---|---|---|---|---|---|---|---|---|---|---|
| A | 0.0009 | 0.11 | 0.08 | 0.012 | 0.007 | 0.003 | 0.93 | — | — | 0.002 | 0.004 | — | — | — | 0.0019 | — |
| B | 0.0011 | 0.01 | 0.16 | 0.007 | 0.005 | 0.035 | 0.56 | 0.06 | 0.01 | — | <0.001 | — | — | — | 0.0052 | — |
| C | 0.0013 | 0.07 | 0.95 | 0.010 | 0.004 | 0.012 | — | 0.12 | 0.02 | — | 0.003 | 0.011 | 0.007 | — | 0.0102 | — |
| D | 0.0010 | 0.02 | 1.15 | 0.038 | 0.002 | 0.010 | 0.45 | — | — | — | 0.002 | — | — | 0.003 | 0.0061 | Sn = 0.03, Cu = 0.1, Ni = 0.05 |
| E | 0.0014 | 0.54 | 1.56 | 0.072 | 0.008 | 0.002 | 0.38 | — | 0.01 | — | 0.002 | — | — | — | 0.0015 | — |
| F | 0.0012 | 0.02 | 0.12 | 0.006 | 0.009 | 0.044 | — | — | — | — | 0.001 | 0.053 | 0.005 | 0.004 | 0.0022 | — |
| G | 0.0034 | 0.01 | 0.10 | 0.009 | 0.006 | 0.039 | — | — | 0.02 | — | 0.002 | 0.007 | 0.005 | — | 0.0018 | — |
| H | 0.0012 | 0.08 | 0.25 | 0.005 | 0.011 | 0.002 | 0.06 | — | — | — | 0.004 | — | — | — | 0.0015 | — |
| I | 0.0008 | 0.20 | 0.13 | 0.064 | 0.005 | 0.001 | 0.03 | 0.01 | — | 0.003 | 0.005 | — | — | — | 0.0023 | — |
| J | 0.019 | 0.01 | 0.09 | 0.008 | 0.003 | 0.016 | 0.17 | — | 0.02 | — | 0.002 | — | — | — | 0.0040 | — |
| K | 0.018 | 0.02 | 0.11 | 0.007 | 0.004 | 0.015 | — | — | — | — | <0.001 | — | — | — | 0.0045 | Sn = 0.05 |
| L | 0.045 | 0.12 | 0.25 | 0.008 | 0.006 | 0.004 | 1.04 | 0.06 | — | — | 0.002 | — | — | — | 0.0053 | — |
| M | 0.052 | 1.21 | 1.24 | 0.011 | 0.001 | 0.010 | 0.51 | — | 0.01 | 0.002 | 0.004 | — | — | — | 0.0074 | — |
| N | 0.095 | 1.17 | 1.54 | 0.003 | 0.002 | 0.015 | 0.66 | 0.09 | 0.01 | 0.003 | 0.003 | — | 0.020 | — | 0.0096 | — |
| O | 0.156 | 1.94 | 1.54 | 0.004 | 0.001 | 0.002 | 0.85 | — | 0.01 | — | 0.002 | — | — | — | 0.0024 | — |
| P | 0.153 | 1.99 | 1.52 | 0.003 | 0.001 | 0.003 | 0.03 | — | — | 0.002 | 0.002 | — | — | — | 0.0023 | — |

| steel | Cr + 3.5 Mo + 39 V | 0.52 Al/N | Remark | |
|---|---|---|---|---|
| A | 0.93 | 0.82 | Hot rolled, Cold-rolled | inventive steel |
| B | 1.16 | 3.50 | Hot rolled | inventive steel |
| C | 1.20 | 0.61 | Hot rolled, Cold-rolled | inventive steel |
| D | 0.45 | 0.85 | Hot rolled, Cold-rolled | inventive steel |
| E | 0.77 | 0.69 | Hot rolled, Cold-rolled | inventive steel |
| F | — | 10.40 | | comparative steel |
| G | 0.78 | 11.27 | | comparative steel |
| H | 0.06 | 0.69 | | comparative steel |
| I | 0.07 | 0.23 | | comparative steel |
| J | 0.95 | 2.08 | Hot rolled | inventive steel |
| K | — | 1.73 | | comparative steel |
| L | 1.25 | 0.39 | Hot rolled, Cold-rolled | inventive steel |
| M | 0.90 | 0.70 | Hot rolled, Cold-rolled | inventive steel |
| N | 1.37 | 0.81 | Hot rolled, Cold-rolled | inventive steel |
| O | 1.24 | 0.43 | Hot rolled, Cold-rolled | inventive steel |
| P | 0.03 | 0.68 | | comparative steel |

(Note) Underlined figures are outside range of present invention

TABLE 2

| steel | Finishing Temperature ° C. | Average cooling rate ° C./s | Coiling temperature ° C. | Structure | Solute N % | TS, MPa | YS, MPa | EI, % | BR-170 MPa | BH-160 MPa | BH-150 MPa | *1 | *2 | Remark |
|---|---|---|---|---|---|---|---|---|---|---|---|---|---|---|
| A | 919 | 50 | 550 | Single phase of Ferrite | 0.0012 | 288 | 157 | 51 | 78 | 72 | 72 | 0.06 | 0.04 | according to present invention |
| A | 925 | 6 | 550 | Single phase of Ferrite | 0.0011 | 291 | 162 | 49 | 82 | 75 | 73 | 0.87 | 0.79 | outside present invention |
| B | 930 | 35 | 450 | Single phase of Ferrite | 0.0028 | 305 | 175 | 47 | 103 | 100 | 96 | 0.11 | 0.05 | according to present invention |
| B | 923 | 7 | 450 | Single phase of Ferrite | 0.0003 | 314 | 183 | 46 | 19 | 13 | 9 | 0 | 0 | outside present invention |
| B | 934 | 30 | 730 | Single phase of Ferrite | 0.0001 | 313 | 182 | 45 | 2 | 0 | 0 | 0 | 0 | outside present invention |
| C | 930 | 55 | 400 | Ferrite + 95% bainitic ferrite | 0.0068 | 376 | 238 | 42 | 119 | 112 | 110 | 0.39 | 0.28 | according to present invention |
| D | 902 | 35 | 500 | Single phase of bainitic ferrite | 0.0047 | 423 | 285 | 38 | 108 | 107 | 108 | 0.35 | 0.26 | according to present invention |
| E | 891 | 30 | 200 | Ferrite + 82% bainitic ferrite | 0.0014 | 466 | 301 | 35 | 86 | 84 | 84 | 0.11 | 0.04 | according to present invention |
| E | 888 | 7 | 450 | Single phase of Ferrite | 0.0012 | 449 | 280 | 37 | 92 | 85 | 81 | 1.86 | 1.83 | outside present invention |
| F | 932 | 40 | 500 | Single phase of Ferrite | 0.0000 | 295 | 154 | 53 | 5 | 2 | 1 | 0 | 0 | outside present invention |
| G | 922 | 40 | 730 | Single phase of Ferrite | 0.0000 | 292 | 160 | 52 | 58 | 42 | 29 | 0.65 | 0.65 | outside present invention |
| H | 930 | 20 | 500 | Single phase of Ferrite | 0.0011 | 286 | 149 | 54 | 65 | 57 | 55 | 0.88 | 0.81 | outside present invention |
| I | 938 | 50 | 400 | Single phase of Ferrite | 0.0018 | 357 | 196 | 44 | 90 | 80 | 78 | 2.14 | 2.04 | outside present invention |
| J | 931 | 30 | 500 | Ferrite + cementite | 0.0009 | 290 | 175 | 53 | 61 | 55 | 55 | 0 | 0 | according to present invention |
| K | 929 | 30 | 500 | Ferrite + cementite | 0.0011 | 298 | 180 | 52 | 64 | 53 | 49 | 0.77 | 0.78 | outside present invention |
| L | 906 | 40 | 550 | Ferrite + cementite | 0.0034 | 341 | 209 | 44 | 107 | 103 | 105 | 0.37 | 0.32 | according to present invention |
| M | 914 | 21 Note 1) | 150 | Ferrite + 12% martensite + 1% bainite | 0.0022 | 609 | 346 | 32 | 125 | 120 | 118 | 0.08 | 0.05 | according to present invention |
| N | 890 | 25 Note 2) | 420 | Ferrite + 7% austenite + 10% bainite | 0.0017 | 614 | 413 | 37 | 90 | 90 | 87 | 0.19 | 0.14 | according to present invention |
| O | 860 | 22 Note 3) | 430 | Ferrite + 12% austenite + 11% bainite + 1% martensite | 0.0010 | 835 | 502 | 32 | 94 | 89 | 87 | 0.11 | 0.07 | according to present invention |
| P | 860 | 22 Note 3) | 430 | Ferrite + 10% austenite + 13% bainite | 0.0007 | 840 | 520 | 31 | 76 | 71 | 72 | 0.94 | 0.92 | outside present invention |

*1: Yield point elongation (%) after heat treatment at 100° C. for 1 hr.
*2: Yield point elongation (%) after heat treatment at 40° C. for 70 days
Note 1) Cooled at 8° C./sec. down to 700° C. after finish rolling, end at 60° C./sec until coiling
Note 2) Cooled at 60° C./sec. down to 760° C. after finish rolling, then at 6° C./sec. down to 700° C., and at 40° C./sec until coiling
Note 3) Cooled at 60° C./sec. down to 710° C. after finish rolling, then at 7° C./sec. down to 620° C., and at 50° C./sec until coiling
(Note) Underlined figures are outside range of present invention Example 2

Steels A, C, D, E, F, I, N, O and P among the steels listed in Table 1 were subjected to the following sequential processes: hot rolling at a slab heating temperature of 1,250° C., a finishing temperature of 930° C. and a coiling temperature of 650° C. to produce hot bands 4.0 mm in thickness; pickling; cold rolling at a reduction ratio of 80% to produce cold-rolled sheets 0.8 mm in thickness; annealing at a heating rate of 10° C./sec. and the maximum heating temperature of 800° C. using a continuous annealing apparatus; cooling at the cooling rates listed in Table 3; averaging treatment for 300 sec. (constant) at different temperatures; and skin-pass rolling at a reduction ratio of 1.0% Then JIS No. 5 test pieces were cut out, and the bake hardenability and the yield point elongation after an artificial aging treatment were measured.

The results are shown in Table 3. As is clear from the table, when steels having the chemical compositions according to the present invention were annealed under appropriate conditions, both high bake hardenability and anti aging property at room temperature were obtained at the same time.

Example 3

Steels A and D among the steels listed in Table 1 were subjected to the following sequential processes: hot rolling at a slab heating temperature of 1,250° C., a finishing temperature of 930° C. and a coiling temperature of 650° C. to produce hot bands 4.0 mm in thickness; pickling; cold rolling at a reduction ratio of 80% to produce cold-rolled sheets 0.8 mm in thickness; then, using a continuous hot dip galvanizing line, annealing at a heating rate of 10° C./sec. and a maximum heating temperature of 800° C., cooling at the cooling rates listed in Table 4, hot dip galvanizing in a zinc bath of 460° C., reheating at a heating rate of 15° C./sec. to 500° C. and holding at the temperature for 15 sec; and skin-pass rolling at a reduction ratio of 0.8%. Then JIS No. 5 test pieces were cut out, and Al, bake hardenability and the yield point elongation after an artificial aging treatment were measured.

The results are shown in Table 4. As is clear from the table, when steel sheets were produced under appropriate conditions, both high bake hardenability and anti aging property at room temperature were obtained at the same time.

TABLE 3

| steel | Average cooling rate ° C./s | Overaging temperature ° C. | structure | Solute N % | TS, MPa | YS, MPa | EI, % | BH170 MPa | BH160 MPa | BH150 MPa | *1 | *2 | Remark |
|---|---|---|---|---|---|---|---|---|---|---|---|---|---|
| A | 70 | 250 | Single phase of ferrite | 0.0010 | 290 | 151 | 52 | 69 | 66 | 64 | 0.05 | 0.02 | according to present invention |
| A | 5 | 250 | Single phase of ferrite | 0.0008 | 285 | 146 | 53 | 59 | 54 | 50 | 0.67 | 0.55 | outside present invention |
| C | 50 | 150 | Single phase of ferrite | 0.0046 | 369 | 222 | 41 | 110 | 108 | 102 | 0.35 | 0.29 | according to present invention |
| C | 5 | 150 | Single phase of ferrite | 0.0042 | 370 | 219 | 42 | 115 | 107 | 104 | 2.76 | 2.44 | outside present invention |
| D | 60 | 200 | Single phase of ferrite | 0.0011 | 376 | 233 | 40 | 74 | 74 | 74 | 0.07 | 0.02 | according to present invention |
| E | 50 | Not applied | Single phase of ferrite | 0.0007 | 454 | 265 | 35 | 63 | 60 | 60 | 0.01 | 0.00 | according to present invention |
| F | 50 | 200 | Single phase of ferrite | 0.0000 | 288 | 158 | 54 | 1 | 0 | 0 | 0.00 | 0.00 | outside present invention |
| I | 40 | 250 | Single phase of ferrite | 0.0017 | 354 | 192 | 45 | 84 | 75 | 69 | 2.56 | 2.23 | outside present invention |
| N | 15 Note 1) | 350 | Ferrite + 8% austenite + 9% bainite | 0.0015 | 628 | 425 | 38 | 84 | 82 | 81 | 0.12 | 0.07 | according to present invention |
| O | 27 Note 2) | 340 | Ferrite + 12% austenite + 10% bainite | 0.0015 | 820 | 487 | 33 | 89 | 89 | 88 | 0.09 | 0.05 | according to present invention |
| P | 27 Note 2) | 340 | Ferrite + 12% austenite + 10% bainite | 0.0007 | 822 | 497 | 32 | 77 | 72 | 67 | 1.06 | 1.22 | outside present invention |

*1: Yield point elongation (%) after heat treatment at 100° C. for 1 hr.

*2: Yield point elongation (%) after heat treatment at 40° C. for 70 days

Note 1) Cooled at 5° C./sec. down to 680° C. and at 60° C./sec. down to overaging temperature Note 2) Cooled at 4° C./sec down to 680° C., and at 80° C./sec. down to overaging temperature (Note) Underlined figures are outside range of present invention

TABLE 4

| Steel | Average Cooling rate ° C./s | Structure | Solute N % | TS, MPa | YS, MPa | EI, % | BH170, MPa | BH160, MPa | BH150, MPa | *1 | *2 | Remark |
|---|---|---|---|---|---|---|---|---|---|---|---|---|
| A | 50 | Single phase of Ferrite | 0.0010 | 300 | 151 | 52 | 70 | 70 | 67 | 0.06 | 0.02 | according to present invention |
| A | 15 | Single phase of Ferrite | 0.0009 | 296 | 146 | 53 | 65 | 63 | 61 | 0.12 | 0.02 | according to present invention |
| A | 5 | Single phase of Ferrite | 0.0008 | 295 | 222 | 41 | 59 | 57 | 53 | 1.54 | 1.37 | outside of present invention |
| D | 50 | Single phase of Ferrite | 0.0014 | 378 | 240 | 40 | 80 | 81 | 80 | 0.13 | 0.08 | according to present invention |
| D | 15 | Single phase of Ferrite | 0.0014 | 372 | 233 | 40 | 79 | 76 | 75 | 0.14 | 0.08 | according to present invention |
| D | 5 | Single phase of Ferrite | 0.0010 | 369 | 230 | 41 | 68 | 65 | 61 | 0.88 | 0.84 | outside of present invention |

*1: Yield point elongation (%) after heat treatment at 100° C. for 1 hr
*2: Yield point elongation (%) after heat treatment at 40° C. for 70 days
(Note) Underlined figures are outside of present invention

Industrial Applicability

A cold-rolled steel sheet, a hot-rolled steel sheet and a galvanized steel sheet having both good bake hardenability and anti aging property at room temperature and capable of maintaining sufficient amount of bake hardenability even when the temperature of BH is low can be obtained by applying the present invention.

Since the steel sheet according to the present invention is a steel sheet having painting bake hardenability, when it is used, its thickness can be made smaller than conventional steel sheets, which means that the weight of the products using the steel sheet can be reduced. The present invention is, therefore, considered to contribute to the conservation of the global environment.

Moreover, the steel sheet according to the present invention is excellent also in the collision energy absorption property and, consequently, contributes to enhancing the safety of a car.

What is claimed is:

1. A cold-railed steel sheet excellent in painting bake hardenability and anti aging property at room temperature characterized by: containing, in mass, 0.0001 to 0.20% of C, 2.0% or less of Si, 3.0% or less of Mn, 0.15% or less of P, 0.015% or less of S and, in addition, 0.10% or less of Al and 0.001 to 0.10% of N so as to satisfy the expression 0.52Al/N<5 and, further, one or more of 2.5% or less of Cr, 1.0% or less of Mo and 0.1% or less of V so as to satisfy the expression (Cr+3.5Mo+39V)≧0.1, with the balance consisting of Fe and unavoidable impurities; having the value of BH170, which is evaluated after applying a 2% tensile deformation and then a heat treatment at 170° C. for 20 min., equal to or more than 45 MPa, and any of the value of BH160, which is evaluated after applying a 2% tensile deformation and then a heat treatment at 160° C. for 10 mm., and the value of BH150, which is evaluated after applying a 2% tensile deformation and then a heat treatment at 150° C. for 10 mm., equal to or more than 35 Mpa; and having the yield point elongation at a tensile test after applying a heat treatment at 100° C. for 1 h. equal to or less than 0.6%.

2. A galvanized cold-rolled steel sheet excellent in painting bake hardenability and anti aging property at room temperature characterized by applying a hot dip galvanizing, an alloying hot dip galvanizing or an electrogalvanizing to a cold-rolled steel sheet according to claim 1.

3. A cold-rolled steel sheet excellent in painting bake hardenability and anti aging property at room temperature according to claim 1, characterized by containing 0.0005 to 0.004%, in mass, of solute N.

4. A cold-rolled steel sheet excellent in painting bake hardenability and anti aging property at room temperature according to claim 1, characterized by containing, further, 0.0005 to 0.01%, in mass, of Ca.

5. A cold-rolled steel sheet excellent in painting bake hardenability and anti aging property at room temperature according to claim 1, characterized by containing, yet further, 0.0001 to 0.001%, in mass, of B.

6. A cold-rolled steel sheet excellent in painting bake hardenability and anti aging property at room temperature according to claim 1, characterized by containing, in addition, 0.001 to 0.03%, in mass, of Nb.

7. A cold-rolled steel sheet excellent in painting bake hardenabiity and anti aging property at room temperature according to claim 1, characterized by containing, moreover, 0.0001 to 0.10%, in mass, of Ti so as to satisfy the expression (N−0.29Ti)>0.0005.

8. A cold-rolled steel sheet excellent in painting bake hardenabiity and anti aging property at room temperature according to claim 1, characterized by containing, furthermore, one or more of Sn, Cu, Ni, Co, Zn, W, Zr and Mg to a total of 0.001 to 1.0% in mass.

9. A hot-rolled steel sheet excellent in painting bake hardenability and anti aging property at room temperature characterized by: containing, in mass, 0.0001 to 0.20% of C, 2.0% or less of Si, 3.0% or less of Mn, 0.15% or less of P, 0.015% or less of S and, in addition, 0.20% or less of Al and 0.001 to 0.10% of N so as to satisfy the expression 0.52Al/N<10 and, further, one or more of 2.5% or less of Cr, 1.0% or less of Mo and 0.1% or less of V so as to satisfy the expression (Cr+3.5Mo+39V)≧0.1, with the balance consisting of Fe and unavoidable impurities; having the value of BH170, which is evaluated after applying a 2% tensile deformation and then a heat treatment at 170° C. for 20 mm., equal to or more than 45 MPa, and any of the value of BH160, which is evaluated after applying a 2% tensile deformation and then a heat treatment at 160° C. for 10 mm., and the value of BH150, which is evaluated after applying a 2% tensile deformation and then a heat treatment of 150° C. for 10 mm., equal to or more than 35 MPa; and having the yield point elongation at a tensile test after applying a heat treatment at 100° C. for 1 h. equal to or less than 0.6%.

10. A galvanized hot-rolled steel sheet excellent in painting bake hardenability and anti aging property at room temperature characterized by applying a hot dip galvanizing, an alloying hot dip galvanizing or an electrogalvanizing to a hot-rolled steel sheet according to claim 9.

11. A hot-rolled steel sheet excellent in painting bake hardenability and anti aging property at room temperature according to claim 9, characterized by containing 0.0005 to 0.004%, in mass, of solute N.

12. A hot-rolled steel sheet excellent in painting bake hardenability and anti aging property at room temperature according to claim characterized by containing, further, 0.0005 to 0.01%, in mass, of Ca.

13. A hot-rolled steel sheet excellent in painting bake hardenability and anti aging property at room temperature according to claim 9, characterized by containing, yet further, 0.0001 to 0.001%, in mass, of B.

14. A hot-rolled steel sheet excellent in painting bake hardenability and anti aging property at room temperature according to claim characterized by containing, in addition, 0.001 to 0.03%, in mass, of Nb.

15. A hot-rolled steel sheet excellent in painting bake hardenability and anti aging property at room temperature according to claim 9, characterized by containing, moreover, 0.0001 to 0.10%, in mass, of Ti so as to satisfy the expression (N−0.29Ti)>0.0005.

16. A hot-rolled steel sheet excellent in painting bake hardenability and anti aging property at room temperature according to claim 9, characterized by containing, furthermore, one or more of Sn, Cu, Ni, Co, Zn, W, Zr and Mg to a total of 0.001 to 1.0%, in mass.

17. A method of producing a hot-rolled steel sheet excellent in painting bake hardenability and anti aging property at room temperature characterized by: hot-rolling a slab having the chemical composition according to claim 9, at a temperature 100° C. below the $Ar_3$ transformation temperature or higher; cooling the hot-rolled steel sheet thus produced from the hot rolling finishing temperature to a temperature of 600° C. or below at an average cooling rate of 10° C./sec. or more; and then coiling it at a temperature of 550° C. or below.

18. A method of producing a cold-rolled steel sheet excellent in painting bake hardenability and anti aging property at room temperature characterized by: hot-rolling a slab having a chemical composition comprising, in mass, 0.0001 to 0.20% of C, 2.0% or less of Si, 3.0% or less of Mn, 0.15% or less of P, 0.015% or less of S and, in addition, 0.10% or less of Al and 0.001 to 0.10% of N so as to satisfy the expression 0.52Al/N 5 and, further, one or more of 2.5% or less of Cr, 1.0% or less of Mo and 0.1% or less of V so as to satisfy the expression (Cr+3.5Mo+39V) 0.1, with the balance consisting of Fe and unavoidable impurities, at a temperature 100° C. below the $Ar_3$ transformation temperature or higher; cold-rolling the hot-rolled steel sheet thus produced at a reduction ratio of 95% or less; annealing the cold-rolled steel sheet thus produced so that the maximum heating temperature attains the temperature range of 600° C. to 1100° C.; and then cooling it from the annealing temperature to a temperature of 400° C. or lower at an average cooling rate of 100°/sec. or more.

19. A method of producing a cold-rolled steel sheet excellent in painting bake hardenability and anti aging property at room temperature characterized by: hot-rolling a slab having a chemical composition comprising, in mass, 0.0001 to 0.20% of C, 2.0% or less of Si, 3.0% or less of Mn, 0.15% or less of P, 0.015% or less of S and, in addition, 0.10% or less of Al and 0.001 to 0.10% of N so as to satisfy the expression 0.52Al/N<5 and, further, one or more of 2.5% or less of Cr, 1.0% or less of Mo and 0.1% or less of V so as to satisfy the expression (Cr+3.5Mo+39V) ≧0.1, with the balance consisting of Fe and unavoidable impurities, at a temperature 100° C. below the $Ar_3$ transformation temperature or higher; cold-rolling the hot-rolled steel sheet thus produced at a reduction ratio of 95% or less; annealing the cold-rolled steel sheet thus produced so that the maximum heating temperature attains the temperature range from 600°C. to 1100°C., then cooling it from the annealing temperature to a temperature of 400° C. or lower at an average cooling rate of 10° C./sec. or more, and then applying to it an over aging treatment at the temperature range from 150 to 400° C. for 120 sec. or longer.

20. A method of producing a hot-dip-galvanized cold-rolled steel sheet excellent in painting bake hardenability and anti aging property at room temperature characterized by: hot-rolling a slab having a chemical composition comprising, in mass, 0.0001 to 0.20% of C, 2.0% or less of Si, 3.0% or less of Mn, 0.15% or less of P, 0.015% or less of S and, in addition, 0.10% or less of Al and 0.001 to 0.10% of N so as to satisfy the expression 0.52Al/N <5 and, further, one or more of 2.5% or less of Cr, 1.0% or less of Mo and 0.1% or less of V so as to satisfy the expression (Cr+3.5Mo+39V)≧0.1, with the balance consisting of Fe and unavoidable impurities, at a temperature 100° C. below the $Ar_3$ transformation temperature or higher; cold-rolling the hot-rolled steel sheet thus produced at a reduction ratio of 95% or less; and then, in a continuous hot dip galvanizing line, annealing the cold-rolled steel sheet thus produced so that the maximum heating temperature attains the temperature range from 600° C. to 1100° C.; then cooling it from the annealing temperature to the temperature of the galvanizing bath at an average cooling rate of 10° C./sec or more, and applying a hot dip galvanizing to it.

21. A method of producing an alloying-hot-dip-galvanized cold-rolled steel sheet excellent in painting bake hardenability and anti aging property at room temperature characterized by conducting a heat treatment in a temperature range from 460 to 650° C. for 3 sec. or longer after the hot-dip galvanizing specified in the method of producing a hot-dip-galvanized cold-rolled steel sheet according to claim 20.

* * * * *

UNITED STATES PATENT AND TRADEMARK OFFICE

CERTIFICATE OF CORRECTION

PATENT NO. : 6,706,419 B2
DATED : March 16, 2004
INVENTOR(S) : Naoki Yoshinaga et al.

It is certified that error appears in the above-identified patent and that said Letters Patent is hereby corrected as shown below:

Column 17,
Line 46, change “cold-railed” to -- cold-rolled --

Column 19,
Line 58, change “39V) 0.1” to -- 39V) ≥0.1 --

Column 20,
Line 7, change “100°/sec” to -- 10°C/sec --

Signed and Sealed this

Second Day of August, 2005

JON W. DUDAS
*Director of the United States Patent and Trademark Office*